United States Patent [19]

Hooke et al.

[11] 4,339,980

[45] Jul. 20, 1982

[54] LOOP TAPE RECORDER

[76] Inventors: Helen Hooke, 29 Glen Ave., Port Chester, N.Y. 10573; David Lerner, 350 Bleecker St., New York, N.Y. 10014

[21] Appl. No.: 182,773

[22] Filed: Aug. 29, 1980

[51] Int. Cl.[3] ..... G10H 3/03

[52] U.S. Cl. ..... 84/1.28; 84/470 R; 84/DIG. 12; 360/12

[58] Field of Search ..... 84/1.28, DIG. 12, 470 R, 84/1.03; 360/12, 27

[56] References Cited

U.S. PATENT DOCUMENTS

| | | | |
|---|---|---|---|
| 3,774,494 | 11/1973 | Reid, Sr. et al. | 84/470 |
| 3,829,597 | 8/1974 | Peterson et al. | 84/DIG. 12 |
| 4,018,448 | 4/1977 | Di Matteo | 84/1.28 |
| 4,020,729 | 5/1977 | Guillemette | 84/1.28 |

*Primary Examiner*—Gene Z. Rubinson
*Assistant Examiner*—Forester W. Isen
*Attorney, Agent, or Firm*—Shlesinger, Fitzsimmons & Shlesinger

[57] ABSTRACT

A series of beat signals (e.g. sixteen) corresponding to a desired rhythm or tempo are recorded on one track of a multi-track magnetic tape, which is then cut and spliced into a loop just long enough to contain the entire series of recorded beats. During a performance the loop is used in a recorder designed to cause the recorded beat signals repeatedly to be played back by a first head at a first terminal, which can be connected through an amplifier to an ear-piece and/or lamp so that the reproduced beat signals can be heard and/or seen only by the performer. A second, combination record-playback-erase head in the recorder is mounted adjacent a second track on the tape and is connected by, for example, a foot-operated switch to a circuit which enables the second head instantaneously to be switched from a record to a playback mode, and vice versa. The performer can then use the foot-operated switch momentarily to switch the second head into its recording mode to record on the second track, during one complete revolution of the tape, background music or rhythm compatible to the beat signals. The last-recorded material can then be amplified and instantly played back through a second terminal to a live audience repeatedly as the performer continues the performance. The beat signals appearing at the first-named terminal can also be utilized to energize a synthesizer or a light show.

11 Claims, 3 Drawing Figures

LOOP TAPE RECORDER

This invention relates to tape recorders, and more particularly to a novel loop-type recording device for use by musicians and the like during live performances. Even more particularly, this invention relates to a novel recording device which enables an individual performer selectively to record and play back his or her own background music or rhythm during a live performance.

It has become quite commonplace for popular musicians to employ a variety of electronic devices which alter or modify in some way the performer's voice or instrument. Phase shifters or so-called fuzz boxes, for example, are frequently used by instrumentalists to create fuzzy overtones in the sound produced by electronic string instruments. While such devices produce some rather unusual sounds for a listening audience, their scope is limited to modifying the audio signals produced by the performance, whether live or recorded.

Contemporary recording studios, of course, have on hand a wide array of sophisticated taping equipment for producing almost fault-free recordings which can be repeatedly modified or doctored. A recording artist, therefore, need not be particularly careful during a recording session because he or she can always repeat all or part of a performance in order to produce an acceptable recording. Moreover, it is not necessary that musicians be present when a vocalist is recording because the orchestral music can be supplied from a tape or the like; and if desired, tape echo units and other multiple track recording devices can be utilized to create echo effects, harmony, etc.

The available equipment for assisting an artist during a live performance, however, is somewhat limited, and certainly far less sophisticated than the equipment that is available in recording studios. Some instruments, for example electronic organs, have built-in circuits which can be used to provide a wide variety of background rhythms in the form of audible beats which can be heard both by the performer and by his or her audience. These beats not only lend a great deal of versatility to the instrument, but also can be used by the performer to set the tempo of the piece that is being played, in much the same manner as a conventional metronone. Few if any other instruments, however, offer a musician similar advantages during a live performance. The players of string instruments for example, normally do not have any associated instrumentation for providing a rhythm background or beat during a live performance, nor do they have the benefit of the sophisticated recording equipment found in studios.

It is an object of this invention therefore, to provide novel recording apparatus which is particularly suited for use by musicians during live performances for the purpose of providing a predetermined rhythmic beat and/or background music for accompanying the musician during his or her performance.

Another object of this invention is to provide novel apparatus of the type described which can be readily manipulated by a musician during a performance for the purpose of recording and changing his or her background accompaniment as desired.

A more specific object of this invention is to provide novel recording apparatus which utilizes a multi-track tape loop having prerecorded on one track thereof a predetermined beat for use by a musician during his or her live performance, and including means operable by the performer selectively to record music on one or more of the other tracks of the tape.

Another object of this invention is to provide tape loop recording apparatus of the type described which can be readily manipulated by a musician during a performance to stop or start the tape loop, and selectively to record, playback or erase material from one or more tracks on said loop.

Other objects of this invention will be apparent hereinafter from the specification and from the recital of the appended claims, particularly when read in conjunction with the accompanying drawings.

Figure 1:
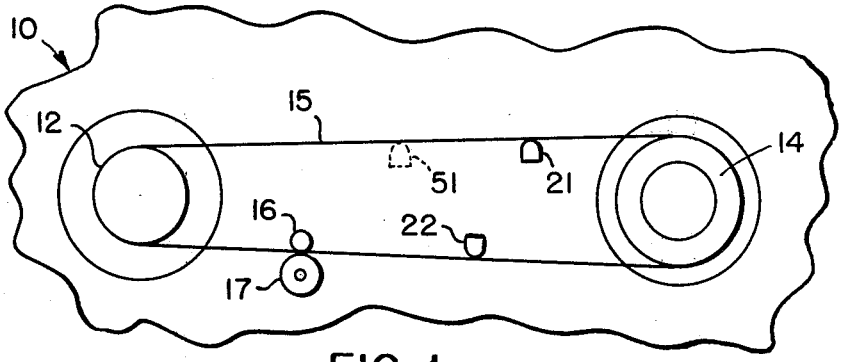
FIG. 1 is a fragmentary plan view of a loop tape recording device made according to one embodiment of this invention, portions only of the housing for the device being shown for purposes of illustration.

Referring now to FIG. 1, numeral 10 denotes generally a tape recorder housing having therein a pair of spaced reels or guide rolls 12 and 14 which are mounted to rotate about spaced, parallel axes. Mounted to travel around the reels 12 and 14 is an endless magnetic tape loop 15, which is releasably gripped between the confronting, peripheral surfaces of a drive capstan 16 and a pressure roller 17, which rotate about axes parallel to the axes of the guide reels 12 and 14. The tape guide reels and drive means 12, 14, 16 and 17 may be similar to those employed in commercially available tape echo devices.

The loop tape 15 of this invention, however, is a specially prepared multi-track tape on one track of which has been recorded a series of like beats which, when played back, provides an endless series of equispaced beats or signals. The loop 15 can be produced, for example, by recording a large number of beats (more than sixteen) on a length of magnetic tape, and then cutting out of the tape a section having a length equal to sixteen beats, and then carefully splicing this section of tape into the loop 15. For the purpose of describing a preferred embodiment of the invention, it will be assumed that one track on the tape 15 (hereinafter the beat track) has recorded thereon sixteen beats, so that for each complete revolution of the tape there will be reproduced, as noted hereinafter, sixteen similar beats or signals.

Referring again to FIG. 1, 21 denotes a conventional tape recorder playback head, which is mounted in housing 10 adjacent the guide reel 14 to register with the beat track of the loop 15. Also mounted in the housing 10 at a fixed distance from the head 21 is a combination erase/record/playback head 22, which is positioned to register with another of the recording tracks on loop 15, and which hereinafter will be referred to as the audio track. Also as noted hereinafter, head 22 is adapted to be utilized by a performer selectively to record on the audio track an audible signal which then can be played back during a performance simultaneously with the signal on the beat track. The performer then will be receiving a predetermined beat signal from the output of head 21 simultaneously with the recorded signal from the head 22.

Figure 2:
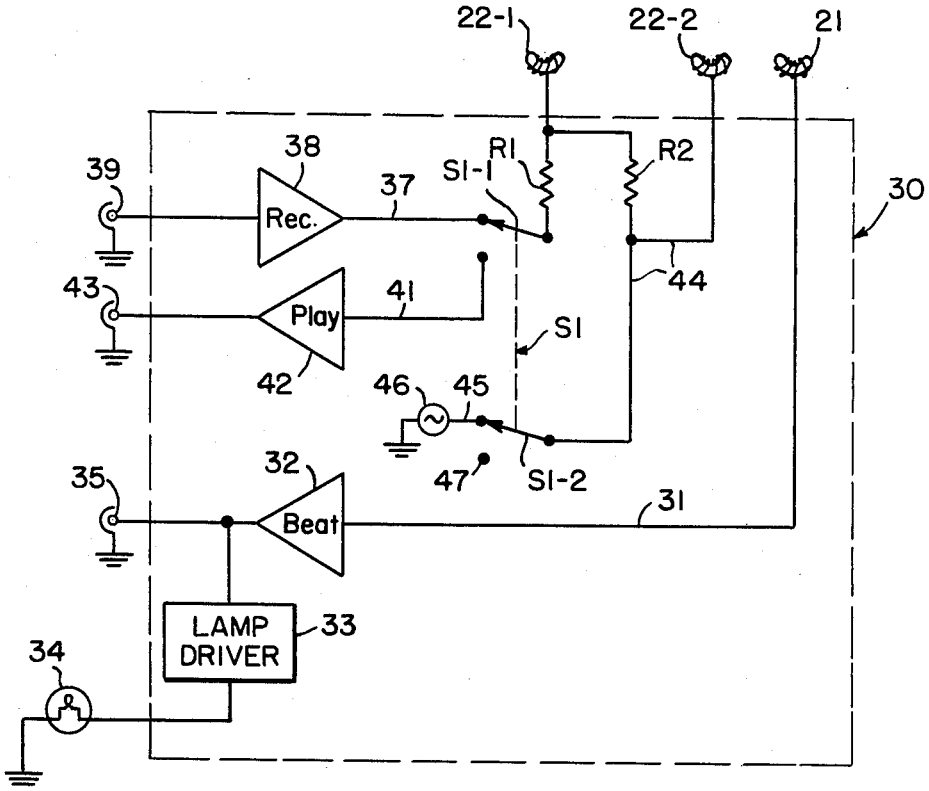
FIG. 2 is a wiring diagram illustrating one manner in which this recording device can be wired to perform its desired function in accordance with a first embodiment of this invention.

Referring now to FIG. 2, 30 denotes generally one type of circuit which can be used for utilizing the tape loop 15 during a performance. For purposes of this description it will be assumed that the drive capstan 16 can be selectively operated in a known manner to drive tape loop 15 at a predetermined, fixed speed. As noted above, it will be assumed also that sixteen similar beats have already been recorded on the beat track of the loop 15.

The signals picked up by beat head 21 from the beat track of loop 15 are applied by a line 31 to the input of a beat amplifier 32, the output of which is fed through a conventional lamp driver 33 to at least one lamp 34. In practice this lamp is positioned near a performer so as to be visible to him or her during a performance. The output of the amplifier at 32 is also applied directly to a terminal 35, which is adapted to be connected, for example, to a conventional earphone, or the like, to provide an audible signal for the performer during a performance. Both types of signals are desirable; and with the light signals the beats need not be audible nor apparent to the live audience.

In FIG. 2 the record and playback section of the head 22 is denoted at 22-1, and the erase section is illustrated at 22-2. Operation of the head section 22-1 selectively as a recording or playback head, respectively, is controlled by a two pole, double-throw switch S having a pair of ganged, movable switch contacts S1-1 and S1-2. The switch contact S1-1 is connected at one end through a resistor R1 to the head section 22-1, and at its opposite end is movable selectively between two different positions. In one position, its record position as shown in FIG. 2, contact S1-1 is connected by line 37 to the output of a recording amplifier 38. The input of amplifier 38 is connected to an audio signal input terminal 39, which is adapted to be connected to the output of a conventional microphone or the like. In its other or second position (not illustrated) the movable contact S1-1 is adapted to be connected by line 41 to the input of a playback amplifier 42, the output of which is connected to an audio output signal terminal 43 that may be connected to, for example, one or more conventional speakers.

The other switch contact S1-2 has one end connected by a line 44 to the head 21, and a movable end engagable in one position (the record position), to line 45, which is connected to the output of a conventional signal oscillator 46 (FIG. 2). At this time, i.e., with the head section 22-1 operating in its recording mode, the oscillator 46 produces a bias current or signal which is applied through the contact S1-2 and line 44 to the erase head section 22-2, whereby the latter is caused to remove from the audio track of loop 15 any previously recorded material. This signal is also applied through another resistor R2 to the head section 22-1.

When the switch S is switched to the playback mode (not illustrated) the switch contact S1-2 is swung into engagement with a dead terminal 47, thereby removing the bias signal from line 44. At this time, therefore, the signal picked up by the head section 22-1 from the second or audio track on loop 15 will be applied through line 41 and the playback amplifier 42 to the audio output terminal 43. It will be apparent, therefore, that regardless of the position of switch S, the intermittent beat signal picked up by the head 21 from the beat track on loop 15 will be applied continuously through the amplifier 32 both to the audible signal output terminal 35, and to the visual signal output as represented by the intermittently illuminated lamp 34.

In practice the switch S preferably is a foot-operated switch which, each time it is depressed, switches from one to the other of its two positions. The advantage of this type of device is that it permits the performer to control both the recording and the playback of the material on the second track of the loop 15, all in synchronization with the beat which has been prerecorded on the beat track of the loop 15. The lamp 34 is intermittently energized in accordance with the signals recorded on the beat track of loop 15, and ideally is placed on or near the housing 10, or in any convenient spot, so that it can be readily viewed by the performer as long as the tape 15 is being driven. In addition to this visual signal, or in lieu thereof, the performer may use the output of terminal 35 to provide an audible signal, which can be heard by the performer by the use of a small ear piece or the like; or the output could be used to trigger a synthesizer or a light show.

When the beat signal is present (i.e., seen and/or heard by the performer) he or she can then push switch S to its recording position (FIG. 2) and record through head section 22-1 and onto the second or audio track of the tape loop, any music or vocal background compatible with the prerecorded beat. This recording continues until the performer has counted sixteen (in the example illustrated) beats, at which time the loop tape 15 will have completed one full revolution past the recording head 22. At this moment the performer once again operates the switch S to return its contacts to the playback positions. Instantly, therefore, signals representing the music which the performer previously had been playing (and had recorded) will now be produced by head section 22-1 at the audio signal output terminal 43, and will continue to be produced repeatatively thereat as long as the tape loop 15 travels. Assuming that the output of contact 43 is applied to a speaker or speakers, both the audience and the performer can now hear the subject matter previously recorded on the second track of the tape loop 15; and if desired, the performer can immediately start to sing or play in harmony with this audible background music or rhythm.

The advantage of this device is that the performer always has available a continuous signal which produces a predetermined beat or rhythm; and in addition, the performer can manipulate the switch S selectively to record and play back any type of sound from the second track of the tape loop 15. This is made possible because of the use of a single head 22 both for recording and for playing back signals from the same audio track; and as a consequence no time is lost between the recording and the playing back of the subject matter from the tape. In other words, since the tape loop 15 is running at a constant speed, and because the beat playback head 21 is located at a fixed distance relative to the combination head 22, perfect synchronization of the live and taped materials can be achieved provided the performer heeds the beat signal produced aurally and/or visually by the output of head 21.

While the invention has been described in connection with a tape loop 15 having thereon sixteen prerecorded beats, it will be apparent to one skilled in the art that the respective number of beats on a particular loop 15 can be altered without departing from this invention. As a matter of fact, preferably a plurality of similar loops 15 would be provided for a performer, with the beat track of each loop having a different number of signals or beats recorded thereon. Each such loop would then be mounted, for example, in a cartirdge, so that it could be readily inserted into a housing 10, and in such manner that the head 21 would register with the beat track and head 22 with the other, audio track. It is anticipated also that the device could incorporate means for adjusting the speed of the capstan 16, so as to enable the loop 15 to be driven selectively at different, predetermined speeds. The number of beats per loop 15 would then remain the same, but the tempo would be increased or decreased accordingly, depending upon whether the speed of the loop was increased or decreased. Obviously also more than the lamp 34 could be driven by the signal output of the driver 33.

Moreover, additional sound tracks on the loop 15 together with additional heads of the combination variety can be employed. For example, a second combination record, playback and erase head 51 (broken lines in FIG. 1) can be employed when a three track tape loop 15 is utilized. In such case head 21 will register with the prerecorded beat track, head 22 will register with one of the two remaining audio tracks, and head 51 will be mounted in housing 10 to register with the third track on the tape.

Figure 3:
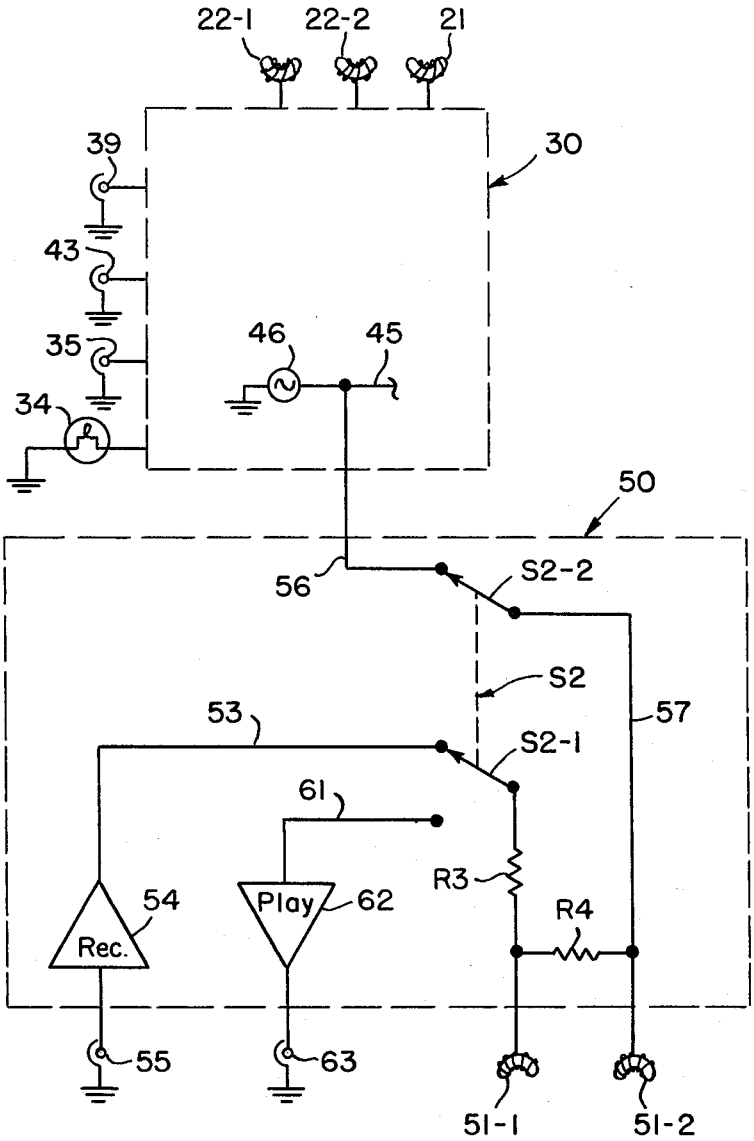
FIG. 3 is a wiring diagram illustrating another manner in which this device may be wired in accordance with a second embodiment of this invention.

In FIG. 3, wherein like numerals are employed to denote elements similar to those described in connection with the first embodiment, head 51 is represented by a combination record and playback head section 51-1, and an erase section 51-2. Section 51-1 is connected through a resister R3 to one end of a movable contact S2-1 of another two-pole, double throw switch S2, which may be similar to, but operable independently of, switch S1. When switch S2 is in its recording mode as shown in FIG. 2, its contact S2-1 is connected by a line 53 to the output of a recording amplifier 54, the input of which is connected to a terminal 55 which is adapted, as in the case of the terminal 39, to be connected to the output of a microphone or to an electronic musical instrument or the like. Also at this time the other movable switch contact S2-2 of switch S2 will be connected at one end by a line 56 to the output of the oscillator 46, and at its opposite end by a line 57 to the erasing section 51-2 of the head 51. As in the case of head 22, a resistor R4 is connected between sections 51-1 and 51-2 of head 51; and during recording the biasing signal from the oscillator cleans or erases previously recorded material from the track on which head 51 is recording.

When switch S2 is moved to its other or playback position (not illustrated), its contact S2-2 engages a dead terminal 59, and its contact S2-1 is moved to a position in which it is connected by a line 61 to the input of a playback amplifier 62, the output of which is fed to a terminal 63 which is connected in a known manner to a speaker or the like. When the switch S2 is in this position, the signal picked up from the third track (the second audio track) on the tape loop 15 by the head section 51-1, will be fed by the amplifier 62 to the terminal 63, and then to one or more speakers.

From the foregoing it will be apparent that the present invention provides a relatively simple and inexpensive means for enabling an artist to add a great deal of variety to a live musical performance. This is particularly true in the case of a solo performance, since the artist himself or herself may operate the above-described device selectively to record on one or both of two different audio tracks on a multiple track loop, merely by selective operation of the switches S1 and S2.

In any case, however, the beat signal from the first or beat track on the loop 15 will always provide the necessary visual and/or audible beat signals for assisting the performer in synchronizing his or her music both with respect to the music which is being played live by the performer, as well as with respect to whatever music the performer may have already recorded on an audio track by use of the head 22 and/or 51.

While they have not been illustrated in detail, it is to be understood that separate switches for supplying power to the heads 22 and 51 can be connected thereto in known manner selectively to energize the heads so that they can be used to record, playback or erase, during travel of the loop 15. Moreover, while head 21 has been described as a playback head, it obviously could be a combination play, record, erase head, provided it is operated only in its playback mode after the desired beats have been recorded on the beat track of loop 15.

While this invention has been described in detail in connection with only one or two audio tracks, in addition to the beat track, it will be apparent that a tape loop having additional audio tracks may be employed, together with the necessary additional combination heads similar to 22 and 51. Also, it is anticipated that the beat signals on tape 15 could also be used (in addition to providing the above-noted audio and visual signals) as an external signal for triggering voltage-controlled units, such as the oscillator on a synthesizer, so that the original beat could be manipulated to create an audio beat of any sound quality—e.g., a bass beat, a drum-like sound, etc. In addition, conventional volume controls can be provided for manipulation by the performer to allow him or her to control the relative and absolute levels of live and recorded audio heard simultaneously by an audience.

It will be apparent that this invention is capable of still further modification, and this application therefore is intended to cover any such modifications as may fall within the scope of one skilled in the art and the appended claims.

What we claim is:

1. A loop tape recording device, comprising a multi-track magnetic tape loop having recorded on one track thereof a predetermined number of spaced beat signals, means for driving said tape loop in an endless path, means mounting a plurality of electronically operated recording heads adjacent said path with each of said heads being disposed in operative registry with a different track on said tape, a first circuit connected to the head which registers with said one track, and operative when this first-name head is energized, to reproduce said predetermined beat signals at a first terminal upon each revolution of said tape loop, and a second circuit connected to a second one of said heads and operable, when said tape is driven and said second head is energized, selectively to record audio signals onto, and to reproduce recorded signals from, a second track on said tape loop, said second circuit including a switch selectively operable instantly to switch said second head between its signal recording and signal reproducing modes, respectively.

2. A loop tape recording device as defined in claim 1, wherein said second head is a combination record, playback and erase head having its record and playback sections positioned to register with substantially the same location on said second track, whereby upon switching from its record to its playback mode it immediately ceases recording signals on said second track and instantly commences to play back any signals previously recorded on said second track.

3. A loop tape recording device as defined in claim 2, wherein both the record and playback sections of said second head are fixed equal distances, respectively, from said first-named head along said path.

4. A loop tape recording device as defined in claim 1, wherein said first circuit includes signaling means connected to said first terminal and operative, when said first head is energized and irrespective of the position of said switch, to produce intermittent signals corresponding to the prerecorded beat signals on said one track.

5. A loop tape device as in claim 4, wherein said signalling means produces an audible signal.

6. A loop tape device as defined in claim 4, wherein said signalling means produces a visible signal.

7. A loop tape recording device as defined in claim 1, including a third circuit connected to a third one of said heads and operable, when said third head is energized, selectively to record audio signals onto, and to reproduce recorded signals from, a third track on said tape loop, and a second switch in said third circuit selectively operable instantly to switch said third head between its signal recording and signal reproducing modes, respectively.

8. A loop tape recording device as defined in claim 7, wherein said switches are manually operable, and said first circuit includes signalling means positioned to be viewable by the person operating said switches, and operative continuously to produce from the recorded signals on said one track a series of intermittent, visible signals corresponding to said recorded signals.

9. A loop tape device as defined in claim 7, wherein said switches are operable independently of each other.

10. A method of supplementing a live musical performance, comprising recording a plurality of beat signals on one track of a multi-track magnetic tape, utilizing said tape for repeatedly reproducing a predetermined series of said recorded beat signals at a first terminal, recording a series of audio signals on a second track on said tape during the reproduction of one of said predetermined series of signals at said first terminal, and without rewinding said tape, audibly reproducing said series of audio signals immediately following said reproduction of said one series of said predetermined signals at said first terminal, and including reproducing said predetermined series of signals audibly or visually from said first terminal for use by a performer during the recording of said audio signals.

11. A method as defined in claim 10, including forming said tape into a loop in which said predetermined series of beat signals are recorded on said one track thereof so as to be repeated once at said first terminal for each revolution of said loop.

* * * * *